US010858019B2

(12) United States Patent
Toth

(10) Patent No.: US 10,858,019 B2
(45) Date of Patent: Dec. 8, 2020

(54) COMMUNICATIONS BETWEEN END OF TRAIN DEVICE AND HEAD OF TRAIN DEVICE

(71) Applicant: Progress Rail Services Corporation, Albertville, AL (US)

(72) Inventor: George E. Toth, Columbia, MD (US)

(73) Assignee: Progress Rail Services Corporation, Albertville, AL (US)

( * ) Notice: Subject to any disclaimer, the term of this patent is extended or adjusted under 35 U.S.C. 154(b) by 401 days.

(21) Appl. No.: 15/815,047

(22) Filed: Nov. 16, 2017

(65) Prior Publication Data

US 2019/0144020 A1 May 16, 2019

(51) Int. Cl.
*B61L 15/00* (2006.01)
*B61L 23/00* (2006.01)

(52) U.S. Cl.
CPC ..... *B61L 15/0027* (2013.01); *B61L 15/0054* (2013.01); *B61L 15/0072* (2013.01); *B61L 23/00* (2013.01); *B61L 15/009* (2013.01)

(58) Field of Classification Search
CPC .. B61L 15/0027; B61L 15/0054; B61L 23/00; B61L 15/0072; B61L 23/34
See application file for complete search history.

(56) References Cited

U.S. PATENT DOCUMENTS 5,681,015 A * 10/1997 Kull ..... B60T 13/665 246/187 C
5,720,454 A * 2/1998 Bachetti ..... B61L 1/188 246/122 R
5,739,768 A * 4/1998 Lane ..... B61L 29/246 340/901
5,757,291 A * 5/1998 Kull ..... B61L 25/025 340/988
5,859,878 A 1/1999 Phillips et al.
5,902,341 A * 5/1999 Wilson ..... B61L 15/0027 246/122 R
5,912,929 A * 6/1999 Molnar ..... G01R 23/15 329/323

(Continued)

FOREIGN PATENT DOCUMENTS

CN 102932381 2/2013
KR 101234939 2/2013

*Primary Examiner* — Zachary L Kuhfuss
(74) *Attorney, Agent, or Firm* — Miller, Matthias & Hull LLP/Caterpillar

(57) ABSTRACT

A device attached to a railcar of a train is provided. The device comprises a radio frequency (RF) transceiver to transmit and receive a RF signal. The device includes a RF modem configured to convert the received RF signal into a low frequency (LF) analog signal. The device includes a digital signal processor to process the LF signal. The digital signal processor includes a phase detector, a loop filter, and a digitally controlled oscillator. The phase detector compares the LF signal and a reference signal to generate an error signal. The phase detector also determines a state of the digital signal processor, the state being one of a lock state or an out of lock state. Further, the phase detector detects an event that the RF signal is lost and generate a loss signal. The loop filter filters the error signal and generates an error control signal. The digitally controlled oscillator generates the reference signal based on the error control signal, the state, and the loss signal.

20 Claims, 3 Drawing Sheets

(56) References Cited

U.S. PATENT DOCUMENTS

| | | | | |
|---|---|---|---|---|
| 6,025,789 | A * | 2/2000 | Lane | B61L 29/246 340/436 |
| 6,115,414 | A * | 9/2000 | Taal | H04W 88/02 375/220 |
| 6,144,900 | A * | 11/2000 | Ali | B61L 15/0027 246/122 R |
| 6,322,025 | B1 * | 11/2001 | Colbert | B61L 15/0027 246/167 R |
| 7,872,591 | B2 | 1/2011 | Kane et al. | |
| 8,918,237 | B2 * | 12/2014 | Morris | B61L 23/34 701/19 |
| 9,083,861 | B2 * | 7/2015 | Haas | B61L 15/0054 |
| 9,994,242 | B2 * | 6/2018 | Bartek | B61L 15/0027 |
| 2008/0195265 | A1 * | 8/2008 | Searle | B61K 9/04 701/19 |
| 2010/0213321 | A1 * | 8/2010 | Kane | B61L 15/0054 246/167 R |
| 2014/0277859 | A1 * | 9/2014 | Morris | B61L 15/0054 701/19 |
| 2016/0096537 | A1 | 4/2016 | Bartek | |
| 2019/0366998 | A1 * | 12/2019 | Bolte | B60T 17/228 |

* cited by examiner

COMMUNICATIONS BETWEEN END OF TRAIN DEVICE AND HEAD OF TRAIN DEVICE

TECHNICAL FIELD

The present disclosure relates to communications between an end of train device and a head of train device. More specifically, the present disclosure relates to improved communications between the end of train device and the head of train device using digital signal processing techniques.

BACKGROUND

Intra-train communications systems are used for monitoring and controlling an operation of a train. These systems typically include a head of train (HOT) device installed in the lead locomotive and an end of train (EOT) device attached to the last car of the train in the place of a caboose. Those systems may also include one more repeaters placed within the train length to augment communications distance.

The EOT/HOT devices typically communicate using ultra-high frequency (UHF) radios conforming to AAR protocol. The EOT/HOT devices are equipped with modems to modulate the radio frequency (RF) signals using fast frequency shift keyed (FFSK) modulation. The EOT/HOT devices include a phase locked loop (PLL) circuit that generally operates in a legacy mode to lock to a frequency of a reference signal. In certain situations such as outage of the reference signal, the PLL circuit loses the lock and a frequency of the output signal of the PLL circuit drifts back to either a center frequency or an edge frequency depending on the design of the PLL circuit. As a result, whenever there is a loss of the reference signal, a significant amount of time is spent in restoring the locked state of the PLL to the incoming signal. Further, the RF signals exchanged between the EOT and HOT devices are well documented and can be decoded and emulated by unauthorized users, making the system vulnerable to security breach.

The UHF radio employed in EOT-HOT communications uses a narrowband channel, whose UHF bandwidth has been further reduced by FCC regulations and yet the need to transmit greater amounts of information is ever increasing. The ability to transfer larger amounts of data through a narrow bandwidth radio system and adherence to the FFSK modulation method employed by EOT/HOT devices results in technical problems. The ability to provide higher bandwidth operation to meet the future needs of data traffic expansion within the capabilities of the assigned narrowband channel presents a significant technical challenge.

Given description covers one or more above mentioned problems and discloses a method and a device to solve the problems.

SUMMARY

In an aspect of the present disclosure, a device attached to a railcar or a locomotive of a train is provided. The device comprises a radio frequency (RF) transceiver configured to transmit and receive a RF signal. The device includes a RF modem configured to convert the received RF signal into a low frequency (LF) analog signal. The device includes a digital signal processor communicably coupled to the RF modem. The digital signal processor includes a phase detector, a loop filter, and a digitally controlled oscillator. The phase detector is configured to receive the LF signal and a reference signal and generate an error signal based on the LF signal and the reference signal. The phase detector is configured to determine a state of the digital signal processor based on the RF signal and the reference signal, the state being one of a lock state or an out of lock state. The phase detector is also configured to detect an event that the RF signal is lost and generate a loss signal. The loop filter is configured to filter the error signal and generate an error control signal. The digitally controlled oscillator is configured to receive the error control signal, the state, and the loss signal and generate the reference signal.

In another aspect of the present disclosure, a method for processing the RF signal at the device attached to the railcar or the locomotive of the train is provided. The method includes receiving the RF signal by the RF transceiver. The method includes converting the RF signal to a low frequency (LF) analog signal using the RF modem. The method also includes receiving, by the digital signal processor, the RF signal from the RF transceiver. The method further includes receiving, by the digital signal processor, the reference signal. The method includes generating, by the digital signal processor, an error signal based on the LF signal and the reference signal. The method includes determining, by the digital signal processor, a state of the digital signal processor based on the LF signal and the reference signal, the state being one of a lock state or an out of lock state. The method includes detecting, by the digital signal processor, an event that the RF signal is lost and generating a loss signal. The method includes filtering, by the digital signal processor, the error signal and generating an error control signal. The method includes generating, by the digital signal processor, the reference signal based on the error control signal, the state, and the loss signal.

In yet another aspect of the present disclosure, a system for communicating a RF signal between an end of train device and a head of train device of a train is disclosed. The head of train device includes a first RF transceiver configured to transmit and receive the RF signal and the end of train device includes a second RF transceiver configured to transmit and receive the RF signal. The end of train device includes the RF modem configured to convert the received RF signal into a low frequency (LF) analog signal. The end of train device includes a digital signal processor connected to the second RF transceiver. The digital signal processor comprises a phase detector, a loop filter, and a digitally controlled oscillator. The phase detector is configured to receive the LF signal and a reference signal and generate an error signal based on the LF signal and the reference signal. The phase detector is configured to determine a state of the digital signal processor based on the LF signal and the reference signal, the state being one of a lock state or an out of lock state. The phase detector is also configured to detect an event that the RF signal is lost and generate a loss signal. The loop filter is configured to filter the error signal and generate an error control signal. The digitally controlled oscillator is configured to receive the error control signal, the state, and the loss signal and generate the reference signal. The end of train device also includes a monitoring unit configured to monitor one or more operating conditions of the train, the monitoring unit communicably coupled to the second RF transceiver.

DETAILED DESCRIPTION

Figure 1:
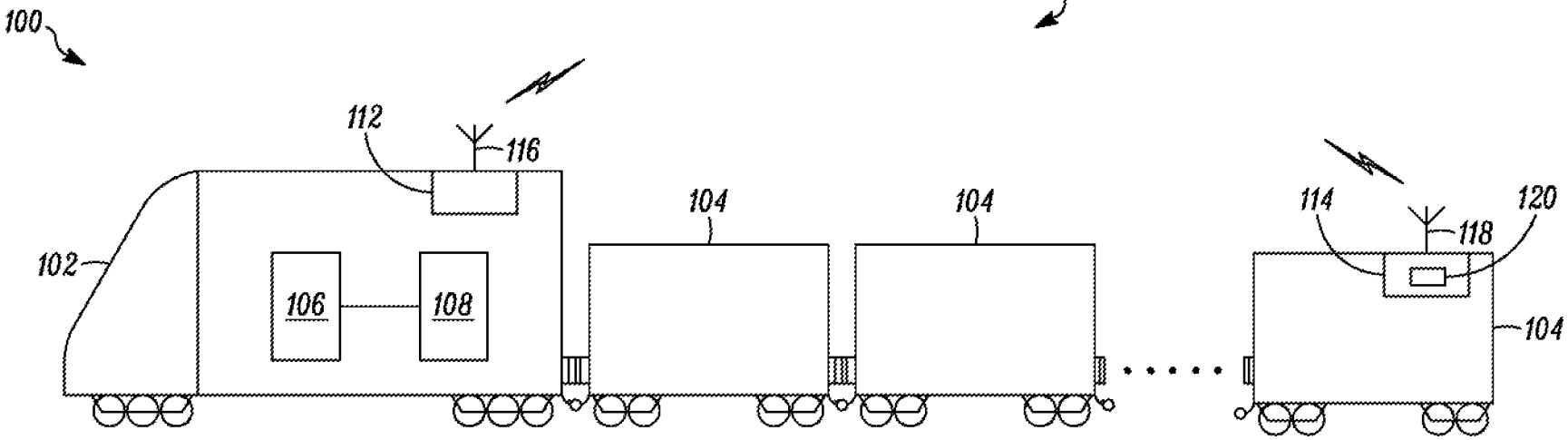
FIG. 1 shows a side view of an exemplary train, according to an aspect of the present disclosure.

Wherever possible, the same reference numbers will be used throughout the drawings to refer to same or like parts. FIG. 1 illustrates a side view of a train 100, according to an example embodiment of the invention. The train 100 includes one or more locomotives 102 and a plurality of railcars 104. The locomotive 102 may be equipped with a locomotive control unit (LCU) 106 and a display 108. The LCU 106 may include a computer which integrates all of the electrical systems of the train 100. While LCU 106 is shown on the lead locomotive 102, an optional configuration would place the LCU 106 on one or more trailing locomotive(s), if the train 100 is so arranged. The display 108 may be configured to display messages, warnings, real-time status, and various other information related to operation of the train 100.

Referring to FIG. 1, a communication system 110 of the train 100 includes a head of train (HOT) device 112 and an end of train (EOT) device 114. The HOT device 112 may be mounted in the locomotive 102. The HOT device 112 may perform a variety of command and control operations associated with the train 100. The HOT device 112 may perform unidirectional or bi-directional intra-train communications with other devices or systems of the train 100. The HOT device 112 includes a first RF transceiver 116 configured to transmit and receive a RF signal. The HOT device 112 may also include various analog and/or digital circuit elements for generating commands and controlling the operation of the train 100.

The EOT device 114 may be mounted on the last railcar 104. The EOT device 114 includes a second RF transceiver 118 configured to transmit and receive the RF signal. In certain embodiments, the EOT device 114 may include a monitoring unit 120 to monitor various operating conditions of the train 100. The monitoring unit 120 is communicably coupled to the second RF transceiver 118. The operating conditions of the train 100 may include, but is not limited to, brake pipe pressure, battery condition, marker light condition, motion status, GPS data, video, still images, and emergency valve status. The EOT device 114 may communicate the information related to the operating conditions to the locomotive 102 via the HOT device 112 so that appropriate command and control decisions may be taken. Subsequently, the information related to the operating conditions may be displayed on the display 108 of the locomotive 102.

The HOT device 112 and the EOT device 114 are configured to exchange information related to the train 100 for monitoring and operation of the train 100. The HOT device 112 and the EOT device 114 may communicate bi-directionally with each other on a wireless communication link. The frequencies to be used for communications are allocated by government agencies. For example, the Federal Communications Commission (FCC) allocates blocks of radio frequencies specifically for rail communications needs. Many of these frequencies are narrowband channels which only permit 6 to 25 kHz analog bandwidth with recent radio spectrum congestion forcing towards narrower bandwidths providing low data rates. The Association of American Railroads (AAR) then further details the method of data-to-analog encoding and its maximum data rate for intra-train communications including the HOT device 112 and the EOT device 114. An AAR compliant HOT device 112 or EOT device 114, for example, transmits and receives data at 1200 baud using Fast Frequency Shift Keying (FFSK) encoding to generate an analog signal which is modulated using frequency modulation technique to generate a high frequency RF signal. The HOT device 112 and the EOT device 114 may be configured to transmit using different modulation techniques as long as the RF signal remains within the allotted 6 to 25 kHz bandwidth. While aspects of the invention have been described with reference to the AAR protocol, it will be understood by those skilled in the art that various other communication protocols used by different countries may be supported by the HOT device 112 and the EOT device 114 without departing from the spirit and scope of the invention.

Figure 2:
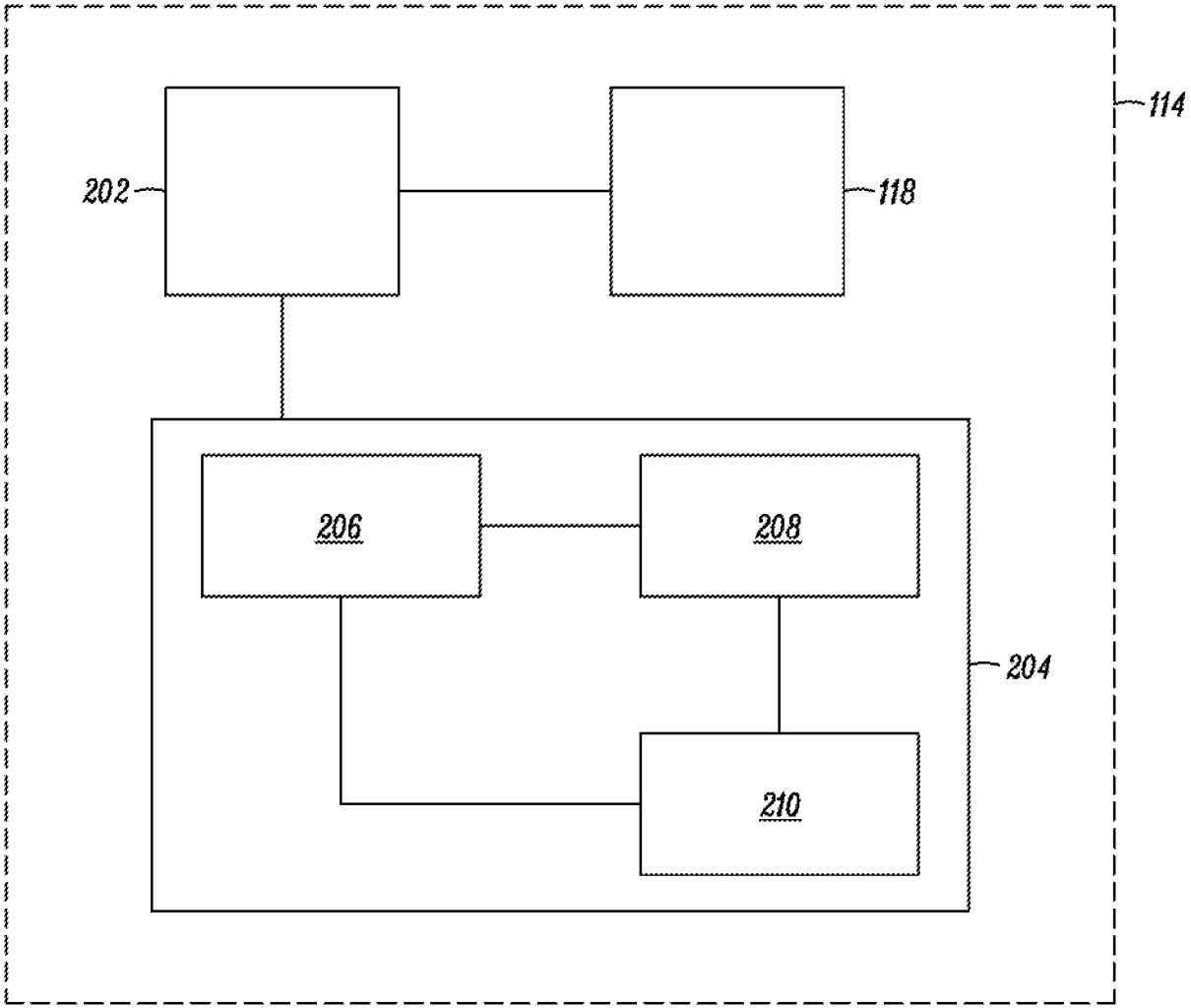
FIG. 2 schematically shows a device configured to communicate radio frequency (RF) signals, according to an aspect of the present disclosure.

FIG. 2 illustrates the EOT device 114 in accordance with certain embodiments of the invention. The EOT device 114 wirelessly communicates with the HOT device 112 using a RF communication link. Based on the AAR protocol, the first RF transceiver 116 of the HOT device 112 may transmit the RF signal at a predefined ultra high frequency (UHF) carrier frequency, for example, 457 megahertz (MHz). The EOT device 114 includes the second RF transceiver 118 configured to transmit and receive the RF signal. The EOT device 114 further includes a RF modem 202 configured to perform conversion between the RF signal and an analog low frequency (LF) signal. The second RF transceiver 118 is communicably coupled to the RF modem 202. The RF modem 202 may include circuitry configured to perform modulation and demodulation of the incoming signal. The EOT device 114 also includes a digital signal processor 204 communicably coupled to the RF modem 202 for further signal processing.

The following embodiment would explain the operation of the EOT device 114 with respect to reception of the RF signal by the second transceiver 118. The received RF signal is passed on to the RF modem 202 for further processing. The RF modem 202 is configured to convert the UHF RF signal to the analog low frequency (LF) signal. The RF modem 202 may include circuitry to perform frequency demodulation of the received RF signal.

As illustrated in FIG. 2, the EOT device 114 includes the digital signal processor 204 communicably coupled to the RF modem 202. The digital signal processor 204 processes the LF signal generated by the RF modem 202. In certain embodiments of the invention, the EOT device 114 may include an analog-to-digital converter (not shown) to convert the LF analog signal into digital data, prior to processing by the digital signal processor 204. The digital signal processor 204 may be configured to perform demodulation of the LF analog signal. In one embodiment, the digital signal processor 204 is configured to perform demodulation of LF signals using FFSK technique.

It may be noted that the digital signal processor 204 may be a single microprocessor or multiple microprocessors that include components for performing functions consistent with the present disclosure. Numerous commercially available microprocessors can be configured to perform the functions of the digital signal processor 204 disclosed herein. It should be appreciated that the digital signal processor 204 could readily be embodied in a general purpose microprocessor capable of controlling numerous functions associated with each of the components present in the EOT device 114. The digital signal processor 204 may also include a memory, a secondary storage device, and any other components for running an application. Various circuits may be associated with the digital signal processor 204 such as power supply circuitry, a solenoid driver circuitry, a signal conditioning circuitry for e.g., an analog-to-digital converter circuitry, a digital-to-analog circuitry, and other types of circuitry. Various routines, algorithms, and/or programs can be programmed within the digital signal processor 204 for execution thereof. Moreover, it should be noted that the digital signal processor 204 disclosed herein may be a stand-alone digital signal processor 204 or may be configured to co-operate with existing processor(s) provided in the EOT device 114 to perform functions that are consistent with the present disclosure.

Referring to FIG. 2, the digital signal processor 204 includes a phase detector 206, a loop filter 208, and a digitally controlled oscillator 210. The phase detector 206 is provided with the LF analog signal received by the digital signal processor 204. The phase detector 206 also receives a reference signal generated by the digitally controlled oscillator 210. The phase detector 206 is configured to compare the phase of the LF signal with the phase of the reference signal. Based on the comparison, the phase detector 206 generates an error signal indicative of the phase difference or frequency difference between the LF analog signal and the reference signal at the specified data rate. As phase and frequency are directly related to each other, it will be understood by a person skilled in the art that various arithmetic processing and calculations associated with the frequency are equally applicable to the phase. The error signal indicates the degree of phase shift needed to achieve absolute concurrency between the reference signal and the LF signal.

The phase detector 206 is configured to determine a state of the digital signal processor 204 based on the comparison of the LF analog signal and the reference signal. The state of the digital signal processor 204 can be at least one of a lock state or an out of lock state. In the lock state, the frequency of the reference signal is equal to the frequency of the LF analog signal while in the out of lock state, the frequency of the reference signal is different from the frequency of the LF analog signal. In instances of high signal variance, the digital signal processor 204 may utilize one or more additional states defining the lock condition to assist in signal recovery and stability under noisy conditions.

During the run of the train 100, the EOT device 114 may not be able to receive the RF signal transmitted by the HOT device 112 in certain situations, such as while the train 100 is passing through congested cities or around a mountain. The phase detector 206 may be configured to detect a loss of signal event indicating that the RF signal is lost and generate a loss signal. In certain embodiments, the loss of signal event may be detected by monitoring a carrier detect signal typically provided by the RF modem 202 to the digital signal processor 204. The phase detector 206 may detect the event based on one or more characteristics of the LF analog signal received by the phase detector 206. For example, the phase detector 206 may determine a number of zero transitions of the LF analog signal within a time and should the number differ from the number of zero transitions as per the modulation technique, the loss of signal event would be detected.

As shown in FIG. 2, the digital signal processor 204 includes the loop filter 208 configured to filter the error signal received from the phase detector 206. In certain embodiments of the invention, quantization noise may be removed by the loop filter 208. The loop filter 208 may be a flexible and programmable digital filter whose coefficients may be changed under software control. The loop filter 208 is configured to generate an error control signal based on the error signal received from the phase detector 206. In typical PLL designs, the loop filter is required to have the characteristics necessary to achieve lock for a PLL with its maximum variance of input frequency, but with the digital loop filter 208, this component can be varied to achieve performance improvements that are not possible in hardware PLLs.

Still referring to FIG. 2, the digital signal processor 204 includes the digitally controlled oscillator 210 configured to generate the reference signal. Specifically, the digitally controlled oscillator 210 generates the reference signal based on the error control signal, the state of the digital signal processor 204, and the loss signal. The reference signal is provided to the phase detector 206. The error control signal is used to tune the phase or the frequency of the reference signal generated by the digitally controlled oscillator 210. At the start of the operation, the digital signal processor 204 is in the out of lock state. The digitally controlled oscillator 210 receives the state indicating the out of lock state and accordingly the digitally controlled oscillator 210 controls the frequency of the reference signal so as to rapidly lock it to the frequency of the LF analog signal. The digitally controlled oscillator 210 may be configured to slew in frequency of the reference signal to achieve the lock state. During the out of lock state, a slew rate may be faster allowing quick slewing and acquisition of the lock state, but once the lock state is achieved, the slew rate may be slowed to allow the frequency of the reference signal to maintain its existing lock state, even when the loss of signal event is detected.

When the frequency of the reference signal matches the frequency of the LF analog signal, the digital signal processor 204 achieves the lock state. The digitally controlled oscillator 210 receives the state indicating the lock state and accordingly the digitally controlled oscillator 210 controls the frequency of the reference signal so as to slowly change the frequency of the reference signal. Further, in cases of loss or outage of the RF signal or the LF analog signal, the digitally controlled oscillator 210 receives the loss signal and the error control signal, and accordingly keeps the frequency of the reference signal unchanged. Thus, during LF analog signal outage, the error control signal is maintained to its last value so as to keep the frequency of the reference signal unchanged. This results in rapid restoration of the lock state in the event of loss of the LF analog signal. This ability to detect the loss of signal event may be further enhanced by the RF modem 202 which usually has a carrier detect signal identifying the condition under which the RF modem 202 is unable to maintain RF lock and so unable to generate a suitable LF analog signal. Once the lock state is restored, the digital signal processor 204 may process the received LF signal to recover the information sent by the HOT device 112.

In this embodiment, the operation of the EOT device 114 or the HOT device 112 is described with respect to transmission of the RF signal via the second transceiver 118 or the first transceiver 116 respectively. With respect to transmission of the RF signal at the EOT device 114, the RF modem 202 may be configured to receive the LF analog signal modulated by the digital signal processor 204. In one embodiment, the digital signal processor 204 may modulate the LF analog signal using fast frequency shift keying modulation. In various embodiments, the digital signal processor 204 may be configured to dynamically change the modulation technique used to modulate the LF analog signal. The EOT device 114 may receive a modulation change signal from the HOT device 114 or the LCU 106 and accordingly, the digital signal processor 204 may change the modulation technique. For example, the digital signal processor 204 may change the modulation technique from fast frequency shift keying modulation to quadrature amplitude modulation. The modulation technique may be selected based on data rate requirements. Thus, the EOT device 114 may be dynamically reprogrammed as per the requirements of an operator of the train 100.

INDUSTRIAL APPLICABILITY

Figure 3:
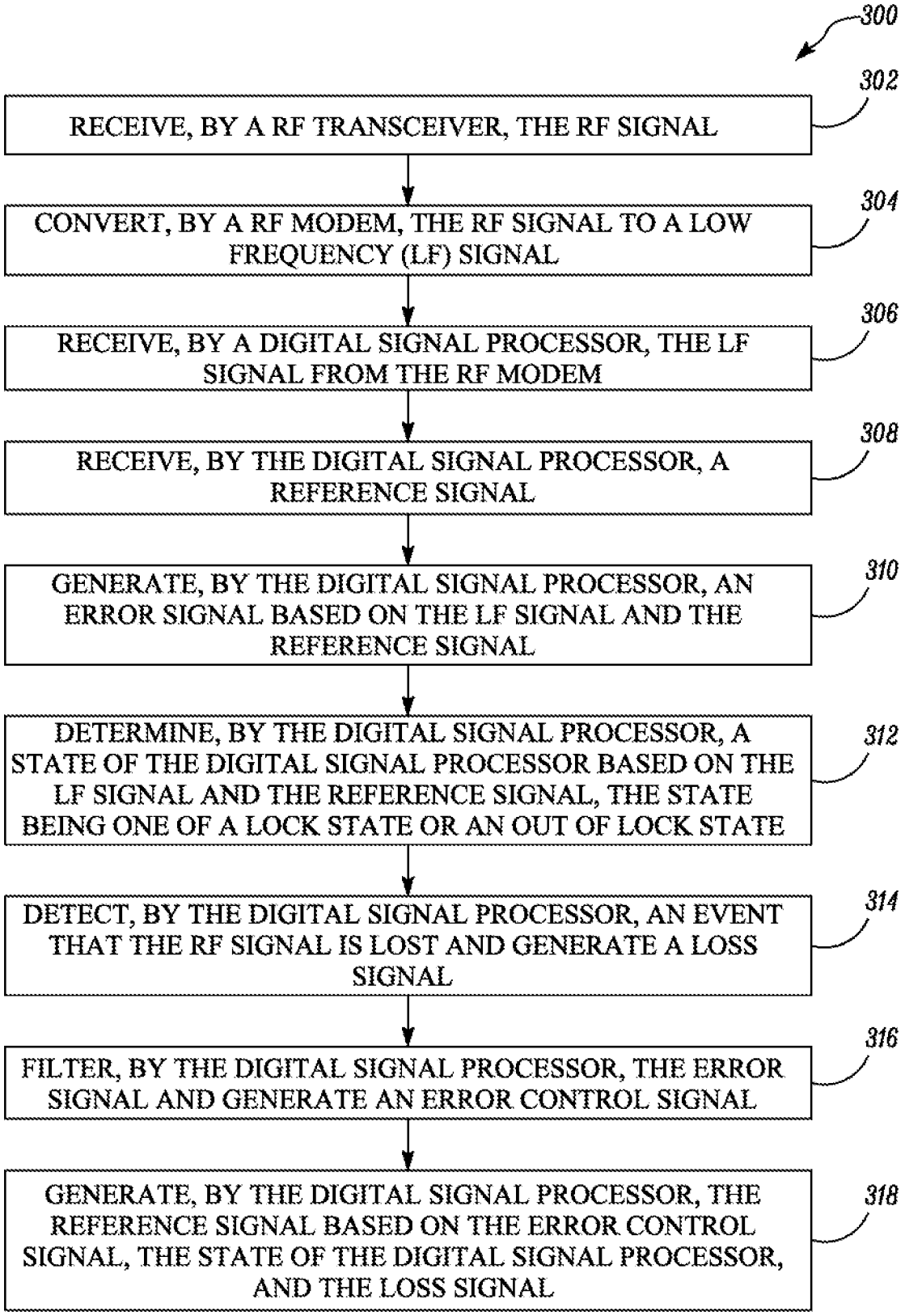
FIG. 3 shows a method for processing the RF signal at the device, according to an aspect of the present disclosure.

The present disclosure provides a method 300 for processing the RF signal received at the EOT device 114 as shown in FIG. 3.

In block 302, the second RF transceiver 118 of the EOT device 114 receives the RF signal. The EOT device 114 may be configured to communicate using AAR protocol. In block 304, the RF signal is provided to the digital signal processor 204 for further processing. In certain embodiments of the invention, the RF signal may be converted into the LF analog signal by the RF modem 202, prior to processing by the digital signal processor 204. In block 306, the LF analog signal from the RF modem is received by the digital signal processor 204.

In block 308, the reference signal is received by the digital signal processor 204. The digital signal processor 204 may compare the frequency of the reference signal with the frequency of the LF analog signal. In block 310, the error signal is generated based on the LF analog signal and the reference signal. The error signal is indicative of the frequency difference or the phase difference between the LF analog signal and the reference signal. In block 312, the method 300 includes determining the state of the digital signal processor 204 based on the LF analog signal and the reference signal. The state of the digital signal processor 204 may be either lock state or out of lock state.

In certain situations, the EOT device 114 may not be able to receive the RF signal transmitted by the HOT device 112. In block 314, the digital signal processor 204 detects the event that the RF signal is lost and generates the loss signal. The digital signal processor 204 may detect the event that the RF signal is lost when a number of zero crossings of the LF analog signal within a time is not equal to a predetermined number of zero crossings in accordance with the modulation technique. In block 316, the error signal is filtered by the digital signal processor 204 and the error control signal is generated.

In block 318, the digital signal processor 204 generates the reference signal based on the error control signal, the state, and the loss signal. In various embodiments, the digital signal processor 204 may control the phase or the frequency of the reference signal based on the error control signal. When the determined state indicates the out of lock state, the digital signal processor 204 may control the frequency of the reference signal so as to rapidly lock it to the frequency of the LF analog signal. When the determined state indicates the lock state, the digital signal processor 204 may control the frequency of the reference signal so as to slowly change the frequency of the reference signal. Further, when there is a loss or an outage of the RF signal, the digital signal processor 204 holds the frequency of the reference signal for some time to allow rapid restoration of the lock state.

While FIG. 2 and FIG. 3 have been described with reference to EOT device 114, a person skilled in the art will appreciate that the embodiments of FIG. 2 and FIG. 3 are equally applicable to the HOT device 112 without departing from the spirit and scope of the invention.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A device attached to a railcar of a train, comprising:

a radio frequency (RF) transceiver configured to transmit and receive a RF signal;

a RF modem communicably coupled to the RF transceiver, the RF modem configured to convert the received RF signal into a low frequency (LF) signal; and a digital signal processor communicably coupled to the RF modem, the digital signal processor comprising:

a phase detector configured to:

receive the LF signal and a reference signal;

generate an error signal based on the LF signal and the reference signal;

determine a state of the digital signal processor based on the LF signal and the reference signal, the state being at least one of a lock state or an out of lock state; and detect an event that the RF signal is lost and generate a loss signal;

a loop filter configured to filter the error signal and generate an error control signal based on the error signal; and a digitally controlled oscillator configured to receive the error control signal, the state, and the loss signal and generate the reference signal based on the error control signal and the state or the error control signal and the loss signal, and the error control signal configured to tune the phase or frequency of the reference signal generated by the digitally controlled oscillator.

2. The device of claim 1, wherein the device is an end of train device or a head of train device.

3. The device of claim 1, wherein the digital signal processor is further configured to determine one or more additional states of the digital signal processor corresponding to the lock state.

4. The device of claim 1 configured to communicate using Association of American Railroads (AAR) protocol.

5. The device of claim 1, wherein the digital signal processor is further configured to modulate and demodulate the LF signal using fast frequency shift keyed (FFSK) technique.

6. The device of claim 5, wherein the digital signal processor is further configured to dynamically change a modulation technique used for modulating and demodulating the LF signal.

7. The device of claim 1, wherein the digitally controlled oscillator is configured to generate the reference signal such that a frequency of the reference signal rapidly locks on to a frequency of the LF signal when the state indicates the out of lock state of the digital signal processor.

8. The device of claim 1, wherein the digitally controlled oscillator is configured to generate the reference signal based on the error control signal and the state such that a frequency of the reference signal is changed slowly when the state indicates the lock state of the digital signal processor.

9. The device of claim 1, wherein the digitally controlled oscillator is configured to generate the reference signal based on the error control signal and the loss signal such that a frequency of the reference signal is kept unchanged when the loss signal indicates that the RF signal is lost.

10. A method for processing a radio frequency (RF) signal at a device attached to a railcar of a train, the method comprising:

receiving, by a RF transceiver, the RF signal;

converting, by a RF modem, the RF signal to a low frequency (LF) signal;

receiving, by a digital signal processor, the LF signal from the RF modem;

receiving, by the digital signal processor, a reference signal;

generating, by the digital signal processor, an error signal based on the LF signal and the reference signal;

determining, by the digital signal processor, a state of the digital signal processor based on the LF signal and the reference signal, the state being at least one of a lock state or an out of lock state;

detecting, by the digital signal processor, an event that the RF signal is lost and generating a loss signal;

filtering, by the digital signal processor, the error signal and generating an error control signal based on the error signal; and generating, by the digital signal processor, the reference signal based on the error control signal and the state or the error control signal and the loss signal.

11. The method of claim 10, wherein the RF transceiver is configured to communicate using Association of American Railroads (AAR) protocol.

12. The method of claim 10, further comprising converting, by an analog-to-digital converter, the LF signal received by the digital signal processor to digital form.

13. The method of claim 10, further comprising modulating and demodulating, by the digital signal processor, the LF signal using fast frequency shift keyed (FFSK) technique.

14. The method of claim 10, further comprising dynamically changing, by the digital signal processor, a modulation technique used for modulating and demodulating the LF signal.

15. The method of claim 10, wherein generating the reference signal comprises controlling a frequency of the reference signal such that the digital signal processor rapidly locks on to a frequency of the LF signal when the state indicates the out of lock state of the digital signal processor.

16. The method of claim 10, wherein generating the reference signal based on the error control signal and the state comprises controlling a frequency of the reference signal such that the frequency changes slowly when the state indicates the lock state of the digital signal processor.

17. The method of claim 10, wherein generating the reference signal based on the error control signal and the loss signal comprises controlling a frequency of the reference signal such that the frequency is kept unchanged when the loss signal indicates that the RF signal is lost.

18. A system for communicating a radio frequency (RF) signal between an end of train device and a head of train device of a train, the system comprising:

the head of train device comprising a first RF transceiver configured to transmit and receive a RF signal; and the end of train device comprising:

a second RF transceiver configured to transmit and receive the RF signal;

a RF modem communicably coupled to the second RF transceiver, the RF modem configured to convert the received RF signal into a low frequency (LF) signal;

a digital signal processor communicably coupled to the RF modem, the digital signal processor comprising;

a phase detector configured to:

receive the RF signal and a reference signal; generate an error signal based on the RF signal and the reference signal;

determine a state of the digital signal processor based on the RF signal and the reference signal, the state being at least one of a lock state or an out of lock state; and detect an event that the RF signal is lost and generate a loss signal;

a loop filter configured to filter the error signal and generate an error control signal based on the error signal;

a digitally controlled oscillator configured to receive the error control signal, the state, and the loss signal and generate the reference signal based on the error control signal and the state or the error control signal and the loss signal, and the error control signal configured to tune the phase or frequency of the reference signal generated by the digitally controlled oscillator; and a monitoring unit communicably coupled to the digital signal processor, the monitoring unit configured to monitor one or more operating conditions of the train.

19. The system of claim 18, further comprising an analog-to-digital converter to convert the LF signal to digital form.

20. The system of claim 18, wherein the first RF transceiver and the second RF transceiver are respectively configured to communicate using Association of American Railroads (AAR) protocol.

* * * * *